US006032797A

United States Patent [19]

Kao

[11] Patent Number: 6,032,797

[45] Date of Patent: Mar. 7, 2000

[54] SOCKET STUD FOR TOOL SUSPENSION RACK

[76] Inventor: Jui-Chien Kao, No. 358, Tunghsing Rd., Shuwang Li, Tali, Taiwan

[21] Appl. No.: 09/258,607

[22] Filed: Feb. 26, 1999

[51] Int. Cl.[7] ..... B65D 85/20

[52] U.S. Cl. ..... 206/378; 206/349; 206/493; 206/806

[58] Field of Search ..... 206/349, 378, 206/493, 806

[56] References Cited

U.S. PATENT DOCUMENTS

| | | | |
|---|---|---|---|
| 3,408,758 | 11/1968 | Doring | 206/486 X |
| 4,043,453 | 8/1977 | Greenlee | 206/493 X |
| 4,729,473 | 3/1988 | Kulzer et al. | 206/486 X |
| 5,279,420 | 1/1994 | Rodgers | 206/493 X |
| 5,425,519 | 6/1995 | Budert | 206/378 X |
| 5,484,056 | 1/1996 | Wood | 206/349 |
| 5,740,911 | 4/1998 | Chou | 206/378 |
| 5,862,913 | 1/1999 | Chou | 206/378 |

*Primary Examiner*—Bryon P. Gehman
*Attorney, Agent, or Firm*—Holland & Hart LLP

[57] ABSTRACT

A socket stud for a tool suspension rack includes a substantially cubic body having two opposite first sides and two opposite second sides, and containing a passage transversely defined through the two first sides, and a snap mounted on one of the two first sides of the substantially cubic body. The snap includes at least one flexible strip having a first side facing opposite the passage and a second side facing the passage, and a retaining boss extending outward from the first side of the flexible strip.

8 Claims, 9 Drawing Sheets

SOCKET STUD FOR TOOL SUSPENSION RACK

CROSS-REFERENCES TO RELATED APPLICATIONS

Not Applicable.

BACKGROUND OF THE INVENTION

1. Field of the Invention

The present invention relates to a socket stud, and more particularly to a socket stud for a tool suspension rack.

2. Description of the Related Art

A first conventional socket suspension rack (60) in accordance with the prior art shown in FIG. 10 comprises a square socket stud (62) containing a cavity (63) therein, a ball (65) received in the cavity (63) and partially exposing outward from the socket stud (62), a spring (64) received in the cavity (63) and abutting the ball (65), and a holder (61) formed on the top of the socket stud (62). A socket (not shown) can be mounted on the socket stud (62), with the ball (65) being detachably received in the depression (not shown) contained in the socket. In such a manner, the holder (61) is secured to an elongated track (not shown), thereby attaching the socket suspension rack (60) together with the socket to the elongated track. However, the spring (64) and the ball (65) must be pressed into the recess (63) after the socket stud (62) is formed by injection molding such that the assembly process of the socket suspension rack (60) is complicated, thereby increasing the cost of making it.

A second conventional socket suspension rack (70) in accordance with the prior art shown in FIG. 11 includes a square socket stud (71) attached to a suspension plate (72) and received in the recess (81) of a socket (80). The socket stud (71) contains an opening (73) defined in the bottom thereof, and includes a retaining stub (74) detachably received in a cavity (82) of the recess (81), thereby attaching the socket (80) to the socket stud (71) of the socket suspension rack (70). However, the opening (73) is contained in the bottom of the socket stud (71) such that two opposed molds (not shown) are needed to make the socket stud (71), and an auxiliary mold (not shown) is additionally needed to form the opening (73), thereby increasing the cost of making the socket stud (71). In addition, the retaining stub (74) has little elasticity, thereby causing inconvenience to detach the retaining stub (74) from the cavity (82).

The present invention has arisen to mitigate and/or obviate the disadvantage of the conventional socket suspension racks.

BRIEF SUMMARY OF THE INVENTION

In accordance with one aspect of the present invention, there is provided a socket stud for a tool suspension rack comprising a substantially cubic body having two opposite first sides and two opposite second sides, and containing a passage transversely defined through the two first sides, and a snap mounted on one of the two first sides of the substantially cubic body. The snap includes at least one flexible strip having a first side facing opposite the passage and a second side facing the passage, and a retaining boss extending outward from the first side of the flexible strip.

In accordance with one embodiment of the present invention, the snap contains four opposite openings and includes two intersecting flexible strips each located between the four opposite openings, and the retaining boss is located at the intersection of the two intersecting flexible strips. The flexible strip includes a triangular protrusion extending outward from the first side thereof, and contains a notch defined in the second side thereof Alternatively, the flexible strip includes a triangular protrusion extending from the second side thereof toward the passage, and contains a notch defined in the first side thereof.

Further benefits and advantages of the present invention will become apparent after a careful reading of the detailed description with appropriate reference to the accompanying drawings.

DETAILED DESCRIPTION OF THE INVENTION

Figure 1:
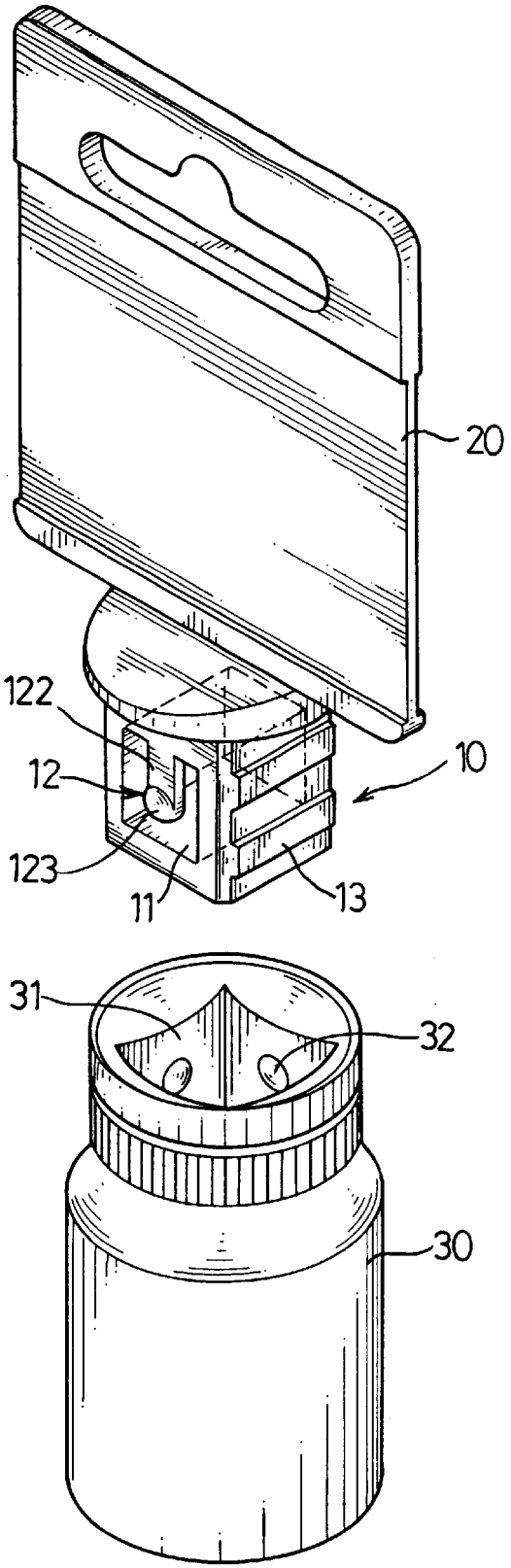
FIG. 1 is a perspective view of a socket stud for a tool suspension rack in accordance with a first embodiment of the present invention.

Referring now to FIGS. 1–4, a socket stud in accordance with the present invention is attached to a tool suspension rack (20) and comprises a substantially cubic body (10) including two opposite first sides and two opposite second sides, and containing a passage (11) transversely defined through the two first sides, and a snap (12) mounted on one of the two first sides of the square body (10), and including at least one flexible strip (122) having a first side facing opposite the passage (11) and a second side facing the passage (11), and a retaining boss (123) extending outward from the first side of the flexible strip (122). The substantially cubic body (10) includes a plurality of elongated ribs (13) formed on each of the two second sides thereof.

Referring to FIG. 1, in accordance with a first embodiment of the present invention, the snap (12) includes a flexible strip (122) extending from the top of one of the two first sides of the substantially cubic body (10) into the passage (11), and the retaining boss (123) extends outward from the distal end of the flexible strip (122).

In operation, a socket (30) is mounted on the socket stud and contains a recess (31) receiving the substantially cubic body (10) therein, and a cavity (32) contained in the recess (31) to receive the retaining boss (123) therein. In such a manner, the retaining boss (123) can be received in and detached from the cavity (32) such that the socket (30) can be fit on and detached from the substantially cubic body (10) of the socket stud.

Figure 2:
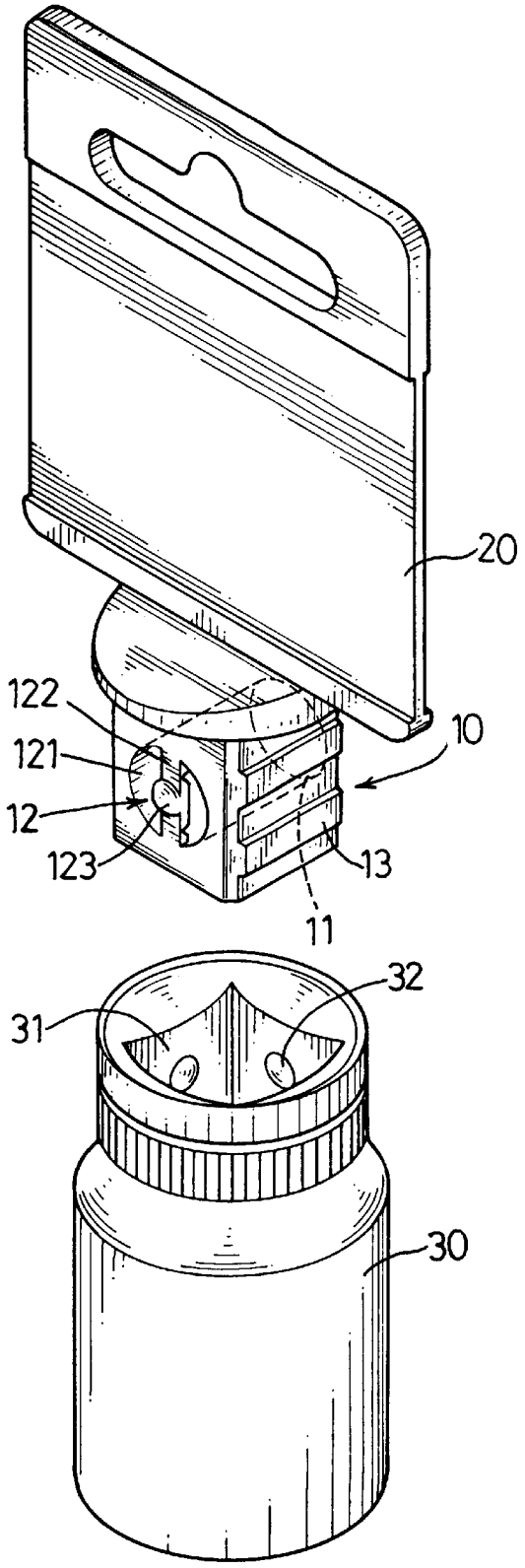
FIG. 2 is a perspective view of a socket stud for a tool suspension rack in accordance with a second embodiment of the present invention.

Referring to FIG. 2, in accordance with a second embodiment of the present invention, the snap (12) contains two opposite openings (121) and includes a flexible strip (122) located between the two opposite openings (121), and the retaining boss (123) is located at the mediate portion of the flexible strip (122).

Figure 3:
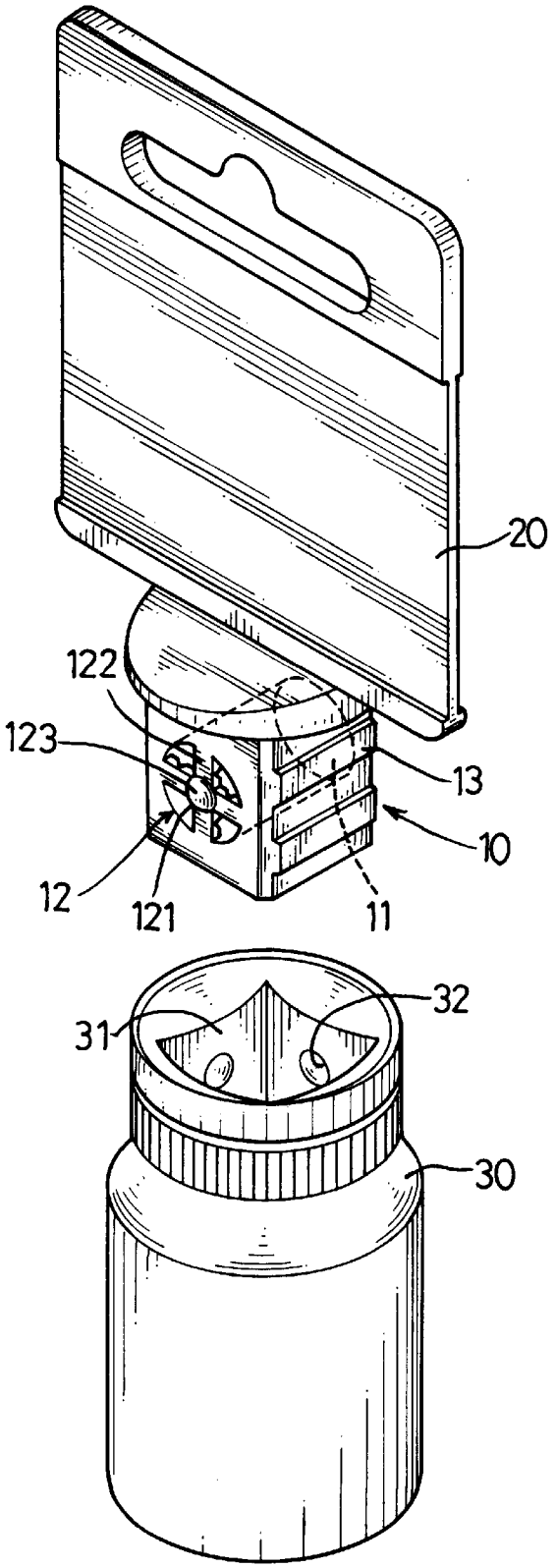
FIG. 3 is a perspective view of a socket stud for a tool suspension rack in accordance with a third embodiment of the present invention.
Figure 4:
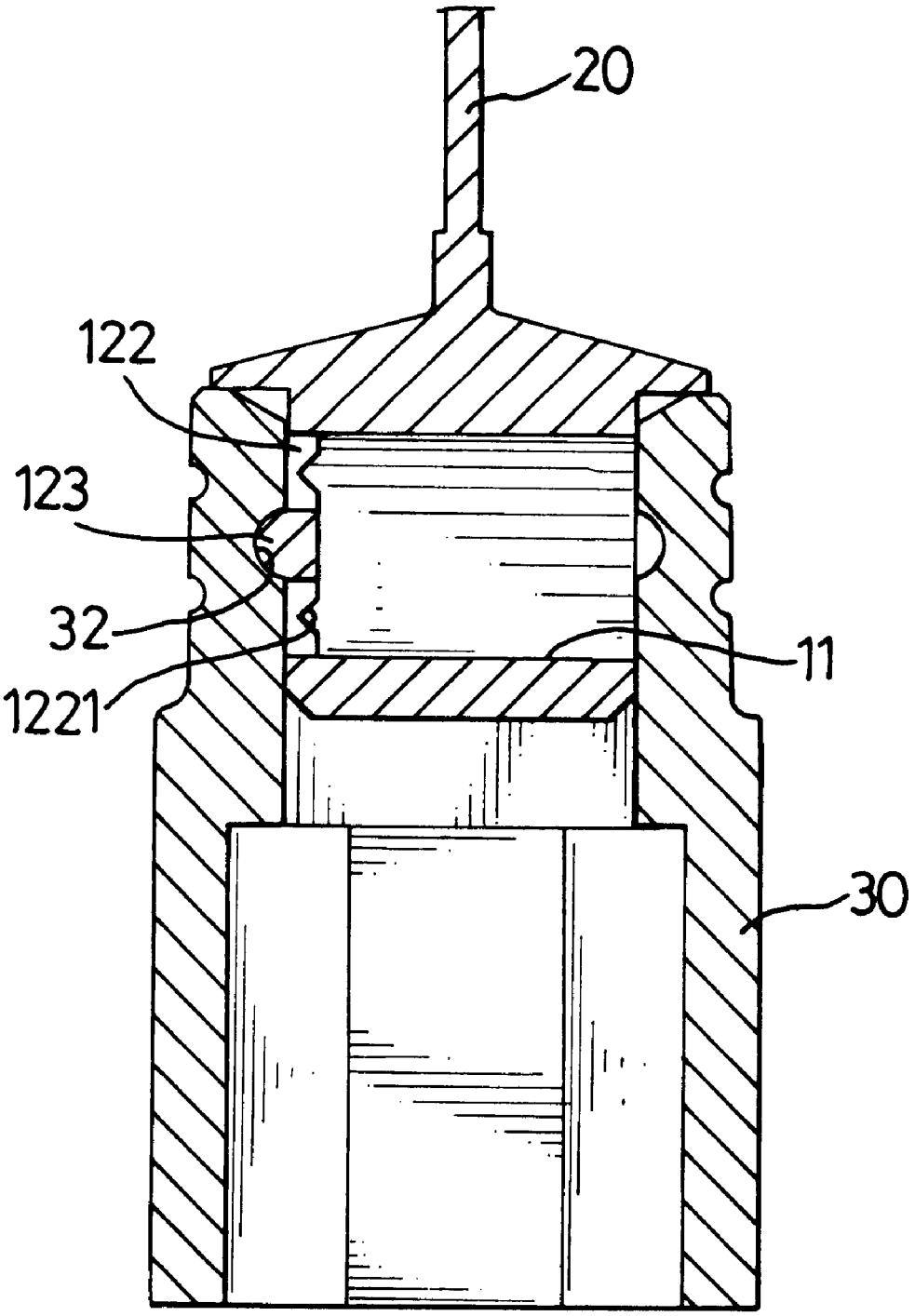
FIG. 4 is a side plan cross-sectional assembly view of the socket stud of the tool suspension rack with the socket as shown in FIG. 3.

Referring to FIGS. 3 and 4, in accordance with a third embodiment of the present invention, the snap (12) contains four radially opposite openings (121) and includes two intersecting flexible strips (122) each located between the four opposite openings (121), and the retaining boss (123) is located at the intersection of the two intersecting flexible strips (122).

Figure 5:
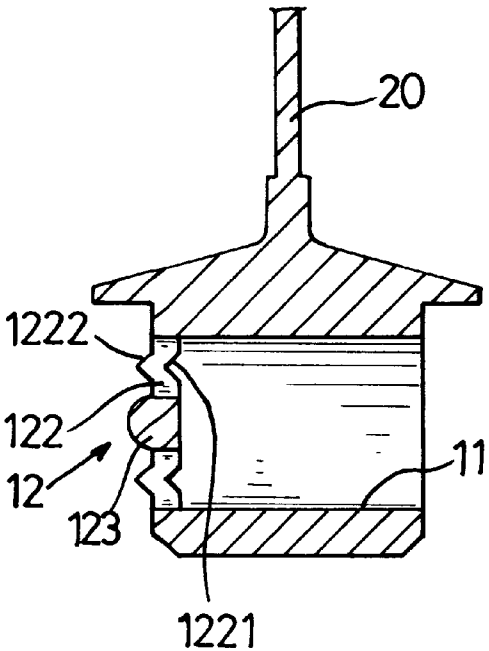
FIG. 5 is a side plan cross-sectional view of the socket stud as shown in FIG. 3 in accordance with an embodiment of the present invention.

Referring to FIG. 5, in accordance with an embodiment of the present invention, the flexible strip (122) includes two triangular protrusions (1222) each extending outward from the first side thereof, and contains two notches (1221) each defined in the second side thereof. In such a manner, the resilience of the flexible strip (122) is enhanced, thereby increasing the mobility of the retaining boss (123).

Figure 6:
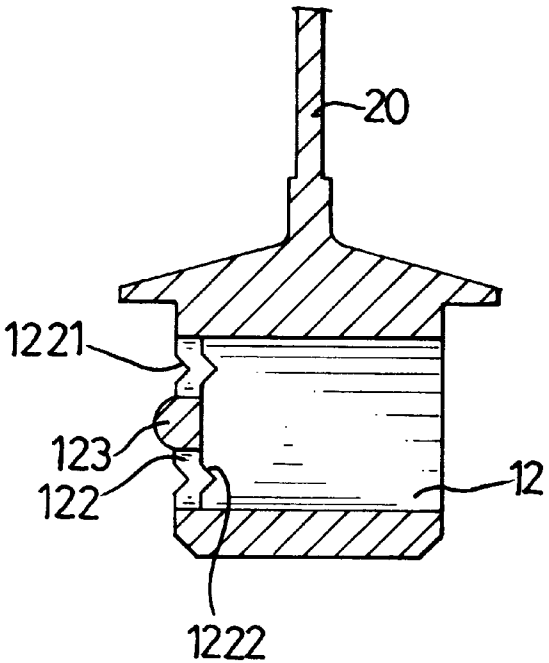
FIG. 6 is a side plan cross-sectional view of the socket stud as shown in FIG. 3 in accordance with another embodiment of the present invention.

Referring to FIG. 6, in accordance with another embodiment of the present invention, the flexible strip (122) includes two triangular protrusions (1222) each extending from the second side thereof toward the passage (11), and contains two notches (1221) each defined in the first side thereof.

Figure 7:
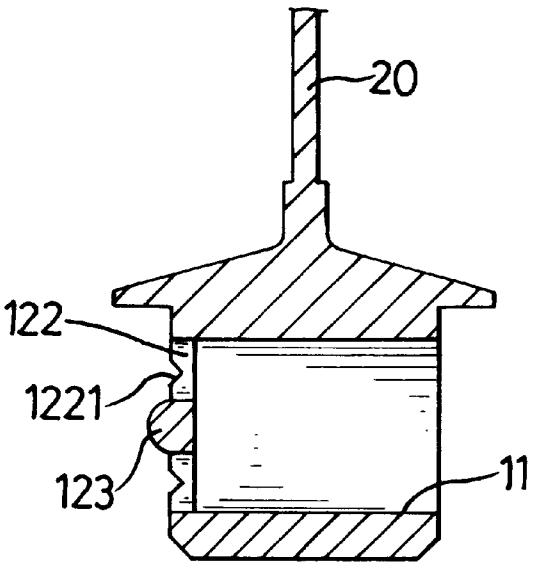
FIG. 7 is a side plan cross-sectional view of the socket stud as shown in FIG. 3 in accordance with a further embodiment of the present invention.

Referring to FIG. 7, in accordance with a further embodiment of the present invention, the flexible strip (122) contains two notches (1221) each defined in the first side thereof.

Figure 8:
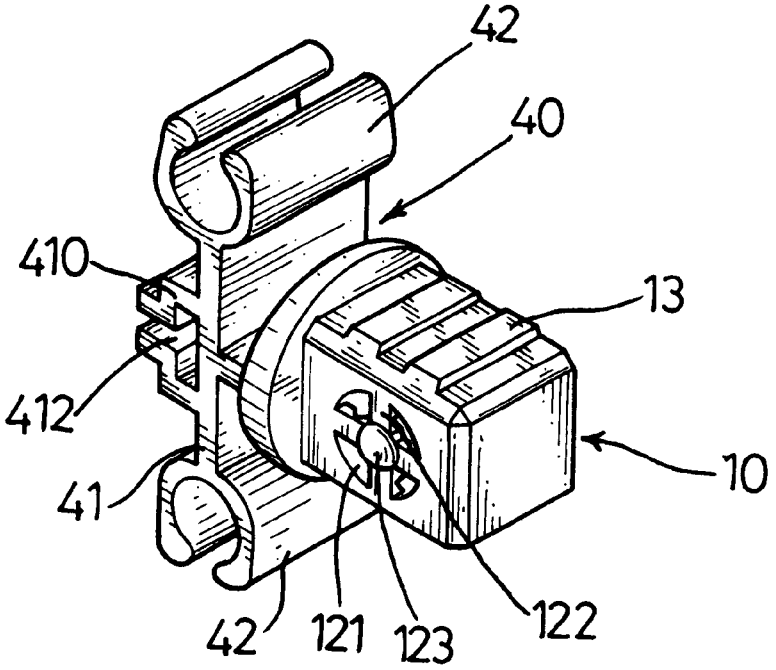
FIG. 8 is a perspective view of a socket stud for a socket rack in accordance with a fourth embodiment of the present invention.
Figure 9:
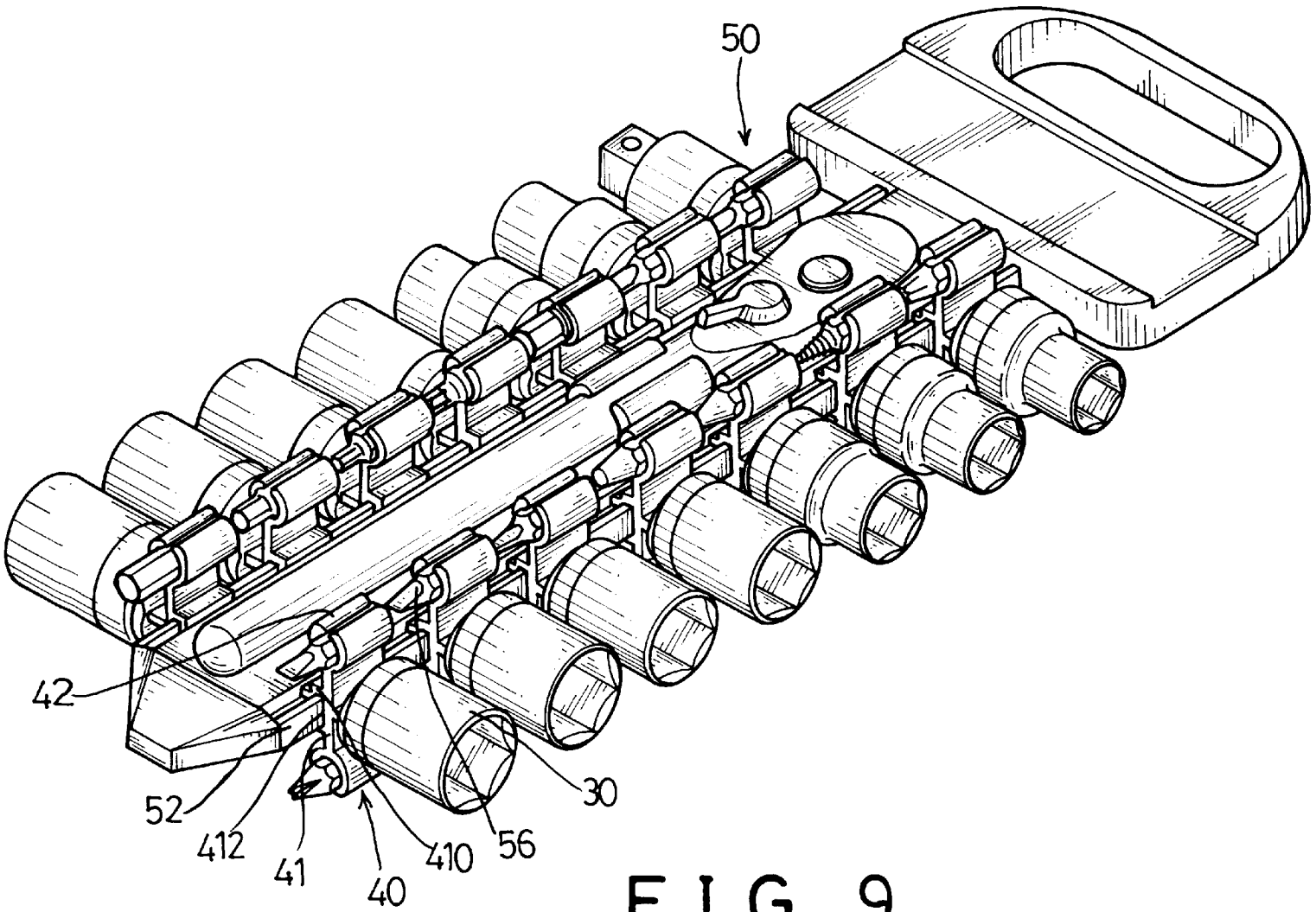
FIG. 9 is perspective view showing the socket rack as shown in FIG. 8 attached to a tool suspension rack.
Figure 10:
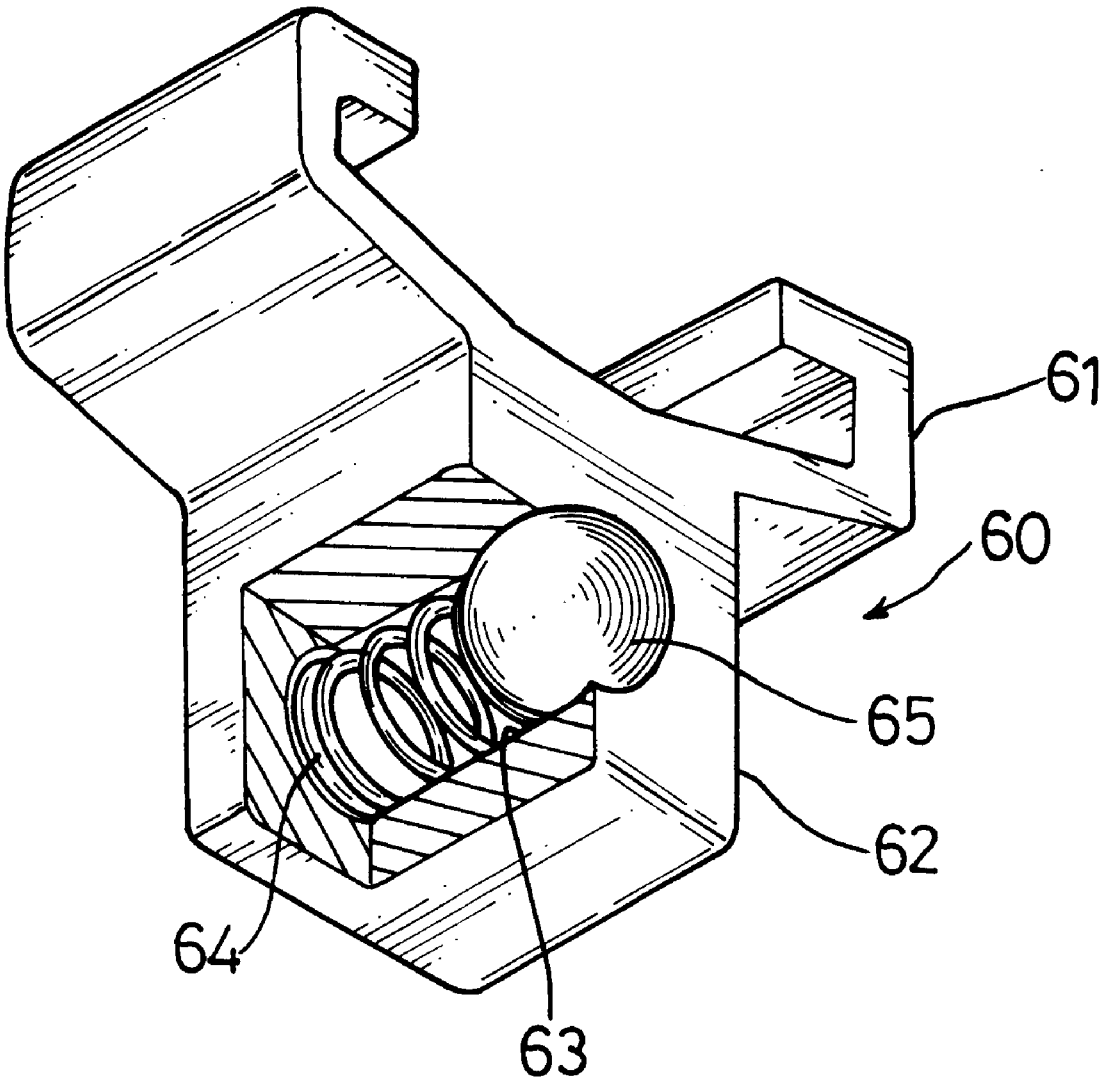
FIG. 10 PRIOR ART
FIG. 10 is a perspective view partially in section of a first conventional socket stud for a socket suspension rack in accordance with the prior art.

Referring now to FIGS. 8 and 9, in accordance with a fourth embodiment of the present invention, the substantially cubic body (10) of the socket stud is attached to a socket rack (40) which includes a flat plate (41) having two distal ends each formed with a C-shaped holder (42) and a mediate portion formed with a hook (410) containing an inverted T-shaped locking recess (412) therein. In such a manner, the socket (30) is fit on the substantially cubic body (10) of the socket stud of the socket rack (40) which is attached to a tool suspension rack (50) by means of the hook (410) being mounted to a guide track (52) of the tool suspension rack (50), thereby hanging the socket (30) on the tool suspension rack (50). The C-shaped holder (42) can be used to hold a tool such as a drive head (56) therein.

Figure 11:
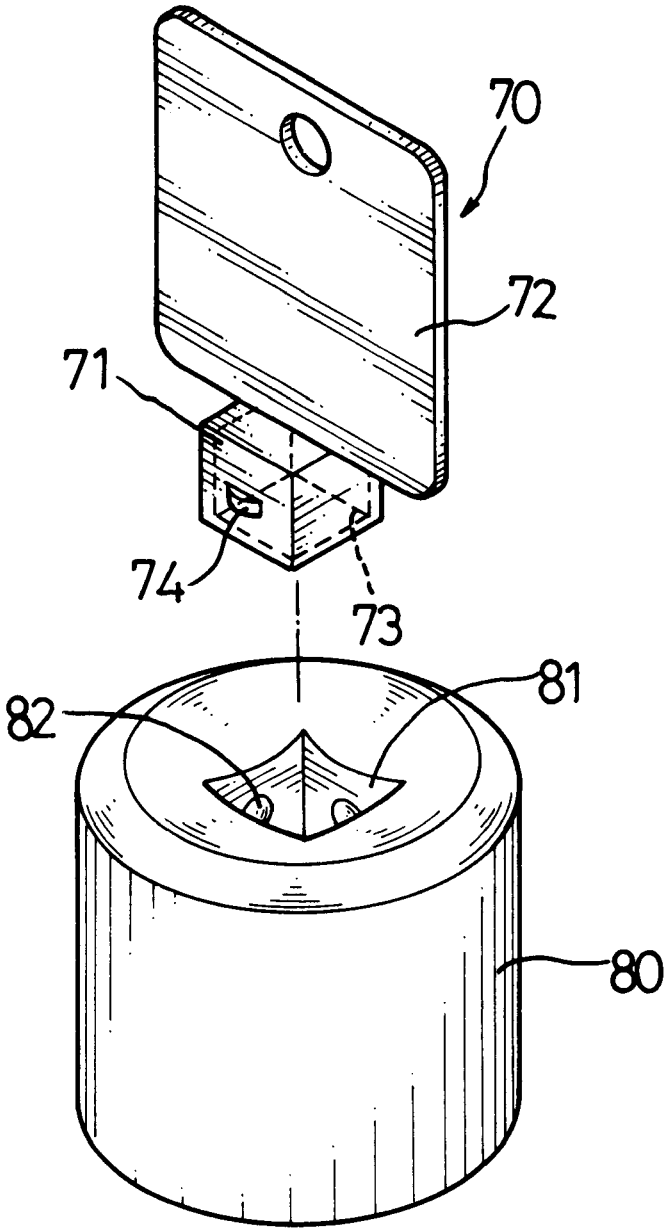
FIG. 11 PRIOR ART
FIG. 11 is a perspective view of a second conventional socket stud for a socket suspension rack in accordance with the prior art.

Accordingly, in accordance with the present invention, the passage (11) is formed in a transverse manner such that only two opposite molds (not shown) are needed to make the substantially cubic body (10) of the socket stud and the transverse passage (11). In such a manner, the cost of making the socket stud is greatly decreased. In comparison, referring to FIG. 11, in the conventional socket suspension rack (70), two opposite molds are needed to make the socket stud (71) and an auxiliary mold is additionally needed to form the opening (73), thereby greatly increasing the cost of making the socket stud (71).

It should be clear to those skilled in the art that further embodiments may be made without departing from the scope and spirit of the present invention.

What is claimed is:

1. A socket stud for a tool suspension rack comprising:

a substantially cubic body (10) including two opposite first sides and two opposite second sides, and containing a passage (11) transversely defined through said two first sides; and a snap (12) mounted on one of said two first sides of said substantially cubic body (10), said snap (12) including at least one flexible strip (122) having a first side facing opposite said passage (11) and a second side facing said passage (11), and a retaining boss (123) extending outward from said first side of said at least one flexible strip (122).

2. The socket stud in accordance with claim 1, wherein said at least one flexible strip (122) extends from one of said two first sides of said substantially cubic body (10) into said passage (11), and said retaining boss (123) extends outward from the distal end of said at least one flexible strip (122).

3. The socket stud in accordance with claim 1, wherein said snap (12) contains two opposite openings (121) and said at least one flexible strip (122) located between said two opposite openings (121), and said retaining boss (123) is located at the mediate position of said at least one flexible strip (122).

4. The socket stud in accordance with claim 1, wherein said snap (12) contains four opposite openings (121) and includes two of said flexible strips (122) intersecting each other and each located between said four opposite openings (121), and said retaining boss (123) is located at the intersection of said two intersecting flexible strips (122).

5. The socket stud in accordance with claim 1, wherein said substantially cubic body (10) includes at least one elongated rib (13) formed on each of the two second sides thereof.

6. The socket stud in accordance with claim 1, wherein said at least one flexible strip (122) includes a triangular protrusion (1222) extending outward from the first side thereof, and contains a notch (1221) defined in the second side thereof.

7. The socket stud in accordance with claim 1, wherein said at least one flexible strip (122) includes a triangular protrusion (1222) extending from the second side thereof toward said passage (11), and contains a notch (1221) defined in the first side thereof.

8. The socket stud in accordance with claim 1, wherein said at least one flexible strip (122) contains a notch (1221) defined in the first side thereof.

* * * * *